US011383364B2

(12) United States Patent
Kochie et al.

(10) Patent No.: US 11,383,364 B2
(45) Date of Patent: Jul. 12, 2022

(54) PULLER TOOL AND ADAPTER

(71) Applicant: Robert Bosch GmbH, Stuttgart (DE)

(72) Inventors: Robert Kochie, Dodge Center, MN (US); Robert Jensen, Clarks Grove, MN (US); Dennis Hanson, Medford, MN (US)

(73) Assignees: Bosch Automotive Service Solutions Inc., Warren (ML); Robert Bosch GmbH, Stuttgart (DE)

( * ) Notice: Subject to any disclaimer, the term of this patent is extended or adjusted under 35 U.S.C. 154(b) by 0 days.

(21) Appl. No.: 17/119,044

(22) Filed: Dec. 11, 2020

(65) Prior Publication Data

US 2022/0184784 A1 Jun. 16, 2022

(51) Int. Cl.
*B25B 27/02* (2006.01)
*B25B 27/06* (2006.01)

(52) U.S. Cl.
CPC ..... *B25B 27/062* (2013.01); *B25B 27/023* (2013.01); *Y10T 29/49822* (2015.01); *Y10T 29/53848* (2015.01); *Y10T 29/53861* (2015.01)

(58) Field of Classification Search
CPC ..... Y10T 29/53861; B25B 27/023; B25B 27/062
USPC ..... 29/259
See application file for complete search history.

(56) References Cited

U.S. PATENT DOCUMENTS 1,123,513 A * 1/1915 Gaillard ..... B25B 27/023 29/261
1,468,976 A * 9/1923 Rickart ..... B25B 27/023 29/264
5,557,833 A * 9/1996 Pool ..... B25B 27/023 29/261
7,669,306 B2 * 3/2010 Palka ..... B25B 27/023 29/261
9,511,488 B2 * 12/2016 Andrews ..... B25B 27/023
2003/0217465 A1 * 11/2003 Shevela ..... B25B 27/062 29/244
2011/0133139 A1 * 6/2011 Betcher ..... B66F 19/00 254/100

OTHER PUBLICATIONS

NBK1560.com. "Vol. 4: What are washers used for?". Aug. 16, 2020. (Machine Translation) (Year: 2020).*

* cited by examiner

*Primary Examiner* — Mahdi H Nejad
(74) *Attorney, Agent, or Firm* — David Kovacek; Maginot, Moore & Beck LLP

(57) ABSTRACT

A puller tool comprises a cross bar with a central portion having a through hole defining a first axis; a forcing screw configured to extend through the through hole; and an adapter detachably attached to the cross bar and having a threaded hole defining a second axis for the forcing screw, and wherein the first axis and second axis are substantially aligned. The adapter comprises a threaded hole configured to receive the forcing screw and defining a second axis, wherein the first axis and second axis are substantially aligned; a base portion containing the threaded hole and arrangeable adjacent a first axial side of the cross bar; at least a first wall portion extending away from the base portion and arrangeable adjacent to a first lateral side of the central portion of the cross bar, and wherein the adapter is detachably attachable to the cross bar.

13 Claims, 3 Drawing Sheets

PULLER TOOL AND ADAPTER

TECHNICAL FIELD

This disclosure relates generally to a puller tool and an adapter. More particularly, the present disclosure relates to a puller tool and adapter for servicing components such as vehicle components for example, wheel hubs, brake drums and brake rotors.

BACKGROUND

Puller tool kits such as the OTC 6575 HUB GRAPPLER tool kit help to remove and install wheel bearings right on the vehicle without alignment. Quick-fit puller legs wrap around hubs and reduce setup time. While these puller tool kits are versatile. There is a desire to make them even more versatile.

SUMMARY

One aspect of this disclosure is directed to a puller tool comprising: a cross bar with a central portion having a through hole defining a first axis; a forcing screw configured to extend through the through hole; and an adapter detachably attached to the cross bar and having a threaded hole defining a second axis for the forcing screw, and wherein the first axis and second axis are substantially aligned.

In some embodiments, the adapter is attachable to the puller tool and detachable from the puller tool without the use of another tool.

In some embodiments, the adapter is attached to the cross bar with at least one attachment device selected from a group consisting of ball detents, thumb screws, clamps, straps, springs, and magnets.

In some embodiments, the cross bar has a first axial side and a second axial side opposite from the first axial side, wherein the adapter is located on the first axial side, and wherein the forcing screw has a bolt head which is located on the second axial side.

In some embodiments, the central portion has a first minimal radial dimension perpendicular to the first axis, the adapter has a base portion containing the threaded hole and at least a first wall portion extending away from the base portion and arranged adjacent to a first lateral side of the central portion of the cross bar, and the first distance from the second axis to the at least first wall portion is at least half as big as the first minimal dimension of the central portion.

the adapter has a second wall portion extending away from the base portion and parallel to the first wall portion, wherein the second wall portion is arranged adjacent to a second lateral side of the central portion of the cross bar opposite from the first lateral side.

In some embodiments, the central portion of the cross bar is arranged between the first wall portion and the second wall portion.

In some embodiments, the first and second wall portions are curved around the central portion.

In some embodiments, the first wall portion and the second wall portion extend along the lateral sides of the cross bar away from the central portion with first and second outer wall segments, wherein the outer wall segments are flat and parallel to each other.

In some embodiments, the adapter is attached to the cross bar with at least one attachment device selected from a group consisting of ball detents, thumb screws, clamps, straps, springs, and magnets, and wherein the at least one attachment device is contained in at least one of the outer wall segments.

In some embodiments, the first lateral side and the second lateral side each have a recess, and wherein the at least one attachment device is arranged in one of the recesses.

In some embodiments, the puller tool comprises jaws arranged on the cross bar and the adapter is located between the jaws.

In some embodiments, further including a kit of auxiliary tools configured to cooperate with the puller tool to remove and replace a hub, wherein the auxiliary tools include at least one of the following: a forcing screw nut to threadably engage an end of the forcing screw, a tube, a bearing installer, a washer, a hex nut, a hex head cap screw, an adapter, a wheel hub installer, a bearing remover, a sleeve, a small adapter assembly, a race puller adapter, an outer tie rod remover, and an adapter for a specific model of car.

Another aspect of this disclosure is directed to an adapter configured to be attached to a cross bar of a puller tool, the cross bar having a central portion, the central portion having a through hole for a forcing screw, the forcing screw configured to extend through the through hole and the through hole defining a first axis, the central portion having a first minimal radial dimension perpendicular to the first axis, the adapter comprising: a threaded hole configured to receive the forcing screw and defining a second axis, wherein the first axis and second axis are substantially alignable; a base portion containing the threaded hole and arrangeable adjacent a first axial side of the cross bar; at least a first wall portion extending away from the base portion and arrangeable adjacent to a first lateral side of the central portion of the cross bar, wherein the at least first wall portion has at least a first distance from the second axis, wherein the first distance is at least half as big as the first minimal radial dimension of the central portion, and wherein the adapter is detachably attachable to the cross bar.

In some embodiments, the adapter is attachable to the cross bar with at least one attachment device selected from a group consisting of ball detents, thumb screws, clamps, straps, springs, and magnets.

In some embodiments, the at least one attachment device is arranged in the at least first wall portion.

In some embodiments, the adapter has a second wall portion extending away from the base portion and arrangeable adjacent to a second lateral side of the central portion of the cross bar opposite from the first lateral side, wherein the second wall portion has at least a second distance from the second axis, wherein the second distance is as big as the first distance so that the central portion is receivable within the adapter, and wherein the adapter is configured to transmit torque from the threaded hole through the base portion and at least one side wall to at least one lateral side of the cross bar.

In some embodiments, the adapter is attachable to the cross bar with at least one attachment device selected from a group consisting of ball detents, thumb screws, clamps, straps, springs, and magnets, and wherein the at least one attachment device is arranged at least in the second wall portion.

In some embodiments, the first and second wall portions are curved around the central portion and wherein the first wall portion and the second wall portion extend along the lateral sides of the cross bar away from the central portion with first and second outer wall segments, and wherein the outer wall segments are flat and parallel to each other.

In some embodiments, the wall portions contain at least two attachment devices selected from a group consisting of ball detents, thumb screws, clamps, straps, springs, and magnets.

The above aspects of this disclosure and other aspects will be explained in greater detail below with reference to the attached drawings.

DETAILED DESCRIPTION

The illustrated embodiment is disclosed with reference to the drawings. However, it is to be understood that the disclosed embodiment is intended to be merely an example that may be embodied in various and alternative forms. The figures are not necessarily to scale and some features may be exaggerated or minimized to show details of particular components. The specific structural and functional details disclosed are not to be interpreted as limiting, but as a representative basis for teaching one skilled in the art how to practice the disclosed concepts.

Figure 1:
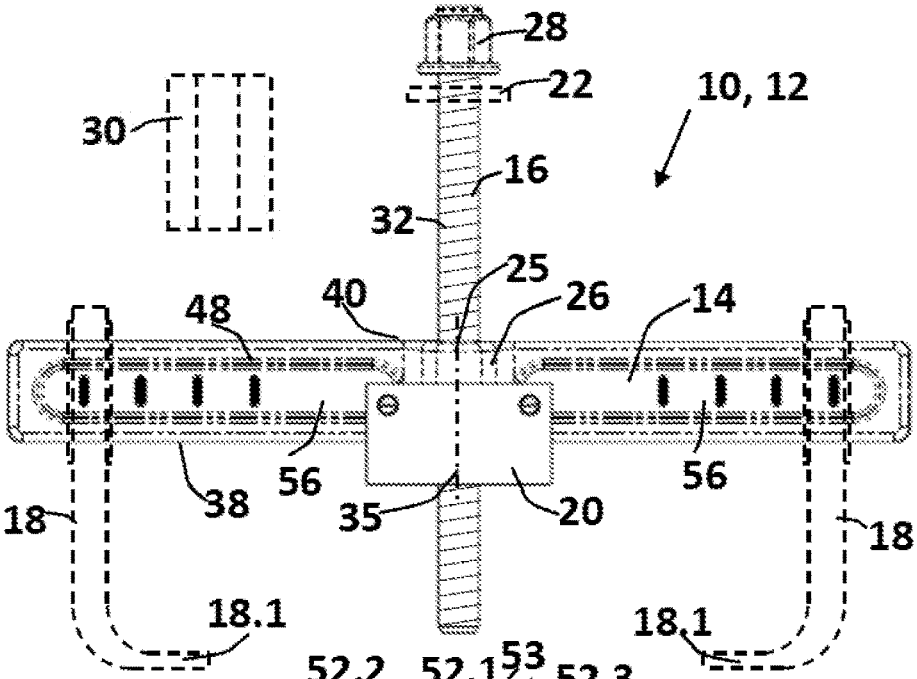
FIG. 1 is a front view of a puller tool with an adapter.
Figure 2:
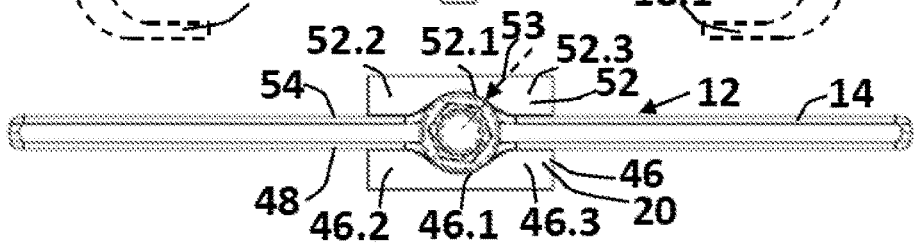
FIG. 2 is a top view FIG. 1.
Figure 3:
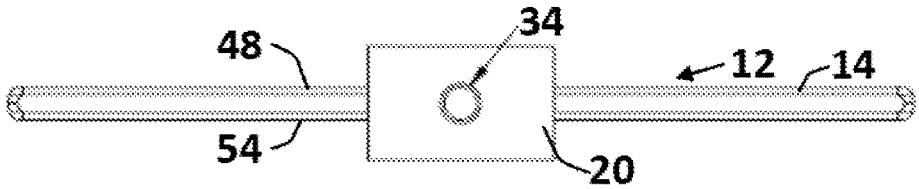
FIG. 3 is a bottom view of FIG. 1.

FIG. 1 illustrates a basic puller tool kit 10. The puller tool kit 10 includes at least a puller tool 12 comprising a cross bar 14, a forcing screw 16, jaws 18 and an adapter 20. The jaws 18, shown with dashed lines, have foot portions 18.1. They can be identical to each other and assembled facing each other. In other embodiments, the jaws 18 may not be identical to each other. They may also be designated as legs. The adapter 20 is located between the jaws 18. The puller tool kit 10 may further comprise a washer 22, shown with dashed lines. The forcing screw 16 is configured to extend through a through hole 24 that has a first axis 25 and that is located in a central portion 26 of the cross bar 14. The through hole 24 is not threaded in accordance with some embodiments and allows the forcing screw 16 to spin freely in the through hole 24. The forcing screw 16 may also include a bolt head 28. The bolt head 28 may be hex shaped and may be configured to be turned by a socket, a wrench, an impact driver or any other suitable tool. The washer 22 may separate the bolt head 28 from the cross bar 14. The puller tool kit 10 may further comprise a forcing screw nut 30, shown with dashed lines. The forcing screw nut 30 has an interior hole with threads that can communicate with threads 32 located on the forcing screw 16. The forcing screw nut 30 may be hex shaped as shown in order to be held or turned by a wrench, or any other suitable tool.

The adapter 20 is detachably attached to the cross bar 14 and has a threaded hole 34 defining a second axis 35 for the forcing screw 16. The first axis 25 and second axis 35 are substantially aligned. Substantially aligned may mean that the first axis 25 and the second axis 35 may be radially offset by up to the size of the gap between the forcing screw 16 and the through hole 24, and if they are not fully parallel they may define an angle of up to 5°.

The cross bar has a first axial side 38 and a second axial side 40 opposite from the first axial side 38. The adapter 20 is located on the first axial side 38. The bolt head 28 is located on the second axial side 40.

The central portion 26 has a first minimal radial dimension 42 perpendicular to the first axis 25. The central portion 26 has a bigger thickness than the remainder of the cross bar 14. The central portion 26 and the remainder of the cross bar 14 may also have an even thickness. The adapter 20 has a base portion 44 containing the threaded hole 34 and a first wall portion 46 extending away from the base portion 44. The first wall portion 46 is arranged adjacent to a first lateral side 48 of the central portion 26 or the cross bar 14. A first distance 50 from the second axis 35 to the first wall portion 46 is at least half as big as the first minimal radial dimension 42 of the central portion 26.

Figure 4:
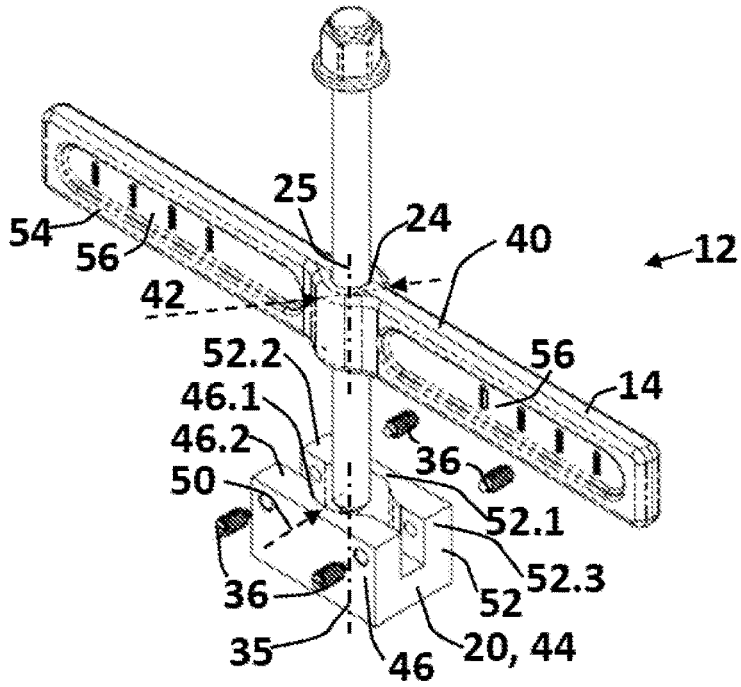
FIG. 4 is a perspective and partially exploded view of the puller tool and adapter.

The adapter 20 may have a second wall portion 52 extending away from the base portion 44 parallel to the first wall portion 46. A second distance 53 from the second axis 35 to the second wall portion 52 is also at least half as big as the first minimal radial dimension 42 of the central portion 26. The second wall portion 52 is arranged adjacent to a second lateral side 54 of the central portion 26 or the cross bar 14 opposite from the first lateral side 48. Therefore, the central portion 26 of the cross bar 14 is arranged between the first wall portion 46 and the second wall portion 52. As can be further seen in FIG. 4, the first and second wall portions 46, 52 are curved around the central portion 26. The resulting diameter of the two curved segments 46.1, 52.1 is bigger than the first minimal radial dimension 42.

The first wall portion 46 and the second wall portion 52 extend along the lateral sides 48, 54 of the cross bar 14 away from the central portion 26 or the curved segments. The first wall portion 46 has a first outer wall segment 46.2 on one side of the curved segment 46.1 and a second outer wall segment 46.3 on the other side of the curved segment 46.1. The first wall portion 52 has a first outer wall segment 52.2 on one side of the curved segment 52.1 and a second outer wall segment 52.3 on the other side of the curved segment 52.1. The first outer wall segments 46.2 and 52.2 are flat and parallel to each other. The second outer wall segments 46.3 and 52.3 are also flat and parallel to each other. This results in the adapter 20 having substantially a U-shaped cross section.

The adapter 20 is attachable to the puller tool 12 and detachable from the puller tool 12 without the use of another tool. For this, the adapter 20 is attached to the cross bar 14 with four ball detents 36. The tips of the four ball detents 36 are in contact with recesses 56 in the lateral sides 48, 54. Each outer wall segment 46.2, 46.3, 52.2, 52.3 contains a ball detent 36. However, it may be sufficient for the adapter 20 to have one, two or three ball detents 36. For assembling the puller tool 12, the cross bar 14 is slid between the first and second wall portions 46, 54. The tips of the ball detents 36 get pushed back until the cross bar 14 reaches the base portion 44 of the adapter 20. The tips of the ball detents 36 come to sit in the recesses 56.

Figure 5:
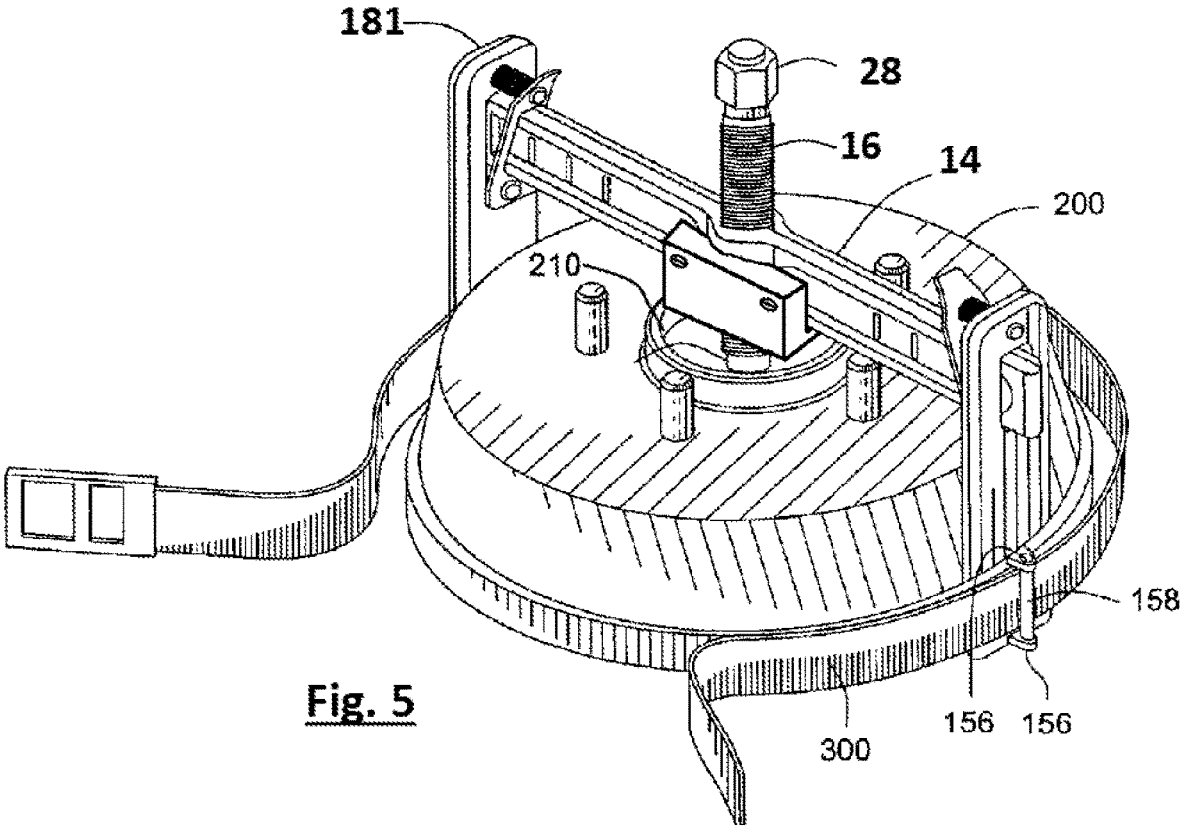
FIG. 5 is a perspective view of a puller tool in use with a brake drum.

FIG. 5 illustrates how the puller tool 12 is used to remove a brake drum 200. The puller tool 12 is engaged with a vehicle component that is being serviced, such as the brake drum 200. The brake drum 200 is installed on a wheel hub 210 and needs to be removed in order to be serviced or replaced. However, the brake drum 200 may be stuck on the wheel hub 210 due to grime, and other contaminants and needs the puller tool 12 in order to be removed from the wheel hub 210. In this view, the puller tool 12 and its components are coupled to the brake drum 200. The forcing screw 16 is engaged with the wheel hub 210 by rotating the forcing screw 16 in a first direction with a rotational tool. When the forcing screw 16 is engaged with the wheel hub 210, the adapter 20 pushes against the cross bar 14 and so the puller tool 12 has leverage to pull on the brake drum 200 when the forcing screw 16 is rotated in a desired direction. Also shown are the jaws 181 with the hooked feet engaged with the brake drum 200 after being positioned. A strap 300 is received around a bottom portion of the jaws 181. In one embodiment, the strap 300 may be secured to the jaws 181 with a holder 158 that is received by retaining tabs 156. The strap 300 can help to ensure that the jaws 181 are properly attached to the brake drum 200. However, the strap 300 is not required to be used with the puller tool 12. By rotating the forcing screw 16 again in the first direction, the adapter 20 and hence the cross bar 14 will move towards the end of the forcing screw 16 engaged with the wheel hub 210 and thus moving the jaws 181 and the brake drum 200 with it. This will allow the brake drum 200 to be removed from the wheel hub 210 and serviced or replaced. In order to remove the puller 12, the forcing screw 16 can be moved in the second direction. Because of the adapter 20, the forcing screw 16 pushes the cross bar 14 and the jaws 181 away from the brake drum. Without the adapter 20 the cross bar 14 with the through hole 24 could not be used to remove the drum brake 200.

At a minimum, the adapter 20 is a threaded block. It has a base portion 44 with a threaded hole 34 and at least one wall portion 46 or 52. This would result in the adapter 20 at least having an L-shaped cross section compared with the U-shaped cross section mentioned above. The at least one wall portion 46 or 52 enables torque from the forcing screw 16 to be transmitted through the threaded hole 34 and at least one wall portion 46 or 52 to the cross bar 14. Because the jaws 181 grappling the brake drum 200 prevent the adapter 20 and cross bar 14 from turning, the brake drum 200, jaws 181, cross bar 14 and adapter 20 move up along the threads 32 of the forcing screw 16 away from the wheel hub 210 until the brake drum 200 no longer sits on the wheel hub 210.

Figure 6:
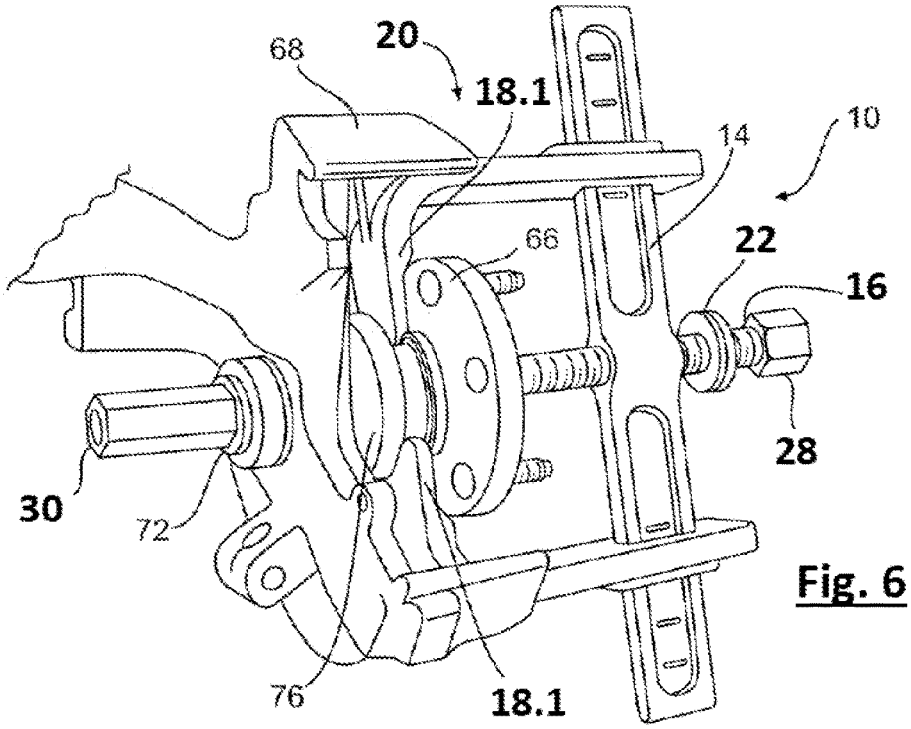
FIG. 6 is a perspective view of a puller tool engaged with a wheel hub on a spindle assembly.

To use the puller tool 12 as illustrated in FIG. 6, the adapter 20 needs to be removed. Due to the ball detents 36, the cross bar 14 can easily be pulled out of the adapter 20 without the need for a tool. A washer 22 is put on the forcing screw 16 between the bolt head 28 and the cross bar 14. The jaws 181 are replaced with jaws 18. FIG. 6 shows a rear perspective view of a puller tool 12 removing a hub 66 from a spindle assembly 68. The bolt head 28 and washer 22 are shown to be spaced away from the cross bar 14 to better illustrate these features. However, under normal operation the bolt head 28 and the washer 22 are not spaced from the cross bar 14. The jaws 18 as positioned so that the foot portions 18.1 are behind the hub 66 and press against a solid portion 76 of the spindle assembly 68. A part 72 may be placed on the forcing screw 16 between the forcing screw nut 30 and the spindle assembly 68 to spread the force generated by the forcing screw nut 30 in a desired way around the back of the hub 66. As the forcing screw 16 is turned in a tightening direction, the forcing screw nut 30 applies force (in some instances via a part 72) against the back of the hub 66 to remove the hub 66 from the spindle assembly 68.

Figure 7:
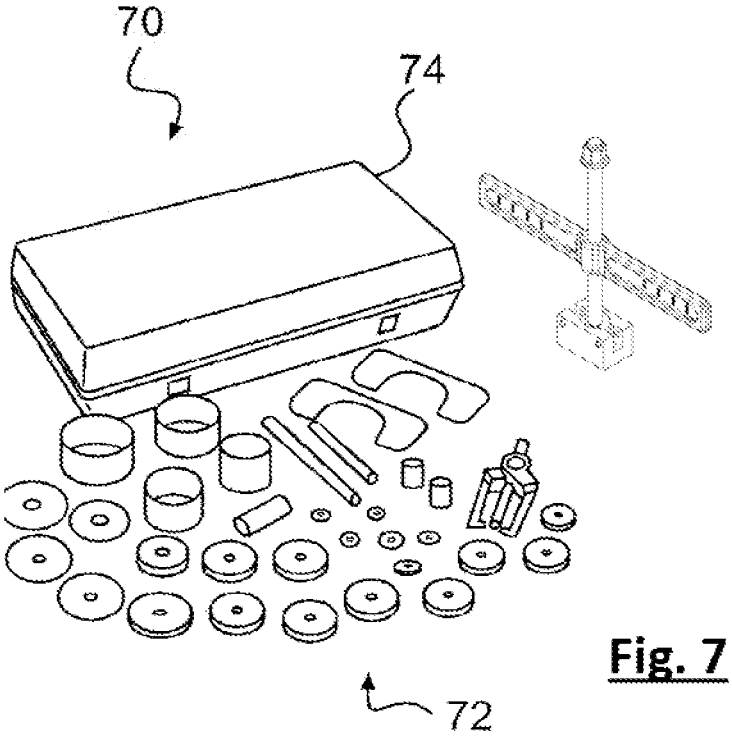
FIG. 7 is a perspective view of a wheel hub remover as a component of a kit of several tools which may be used in removing and replacing a wheel hub for a wheel hub apparatus

FIG. 7 shows the basic puller tool kit 10 or puller tool 12 as part of a kit 70 of auxiliary tools configured to cooperate with the puller tool 12 to remove and replace a hub, brake drum or brake rotor. The puller tool kit 10 and auxiliary tools can be fit in a carrying case 74. The auxiliary tools include some or all, but at least one of the following: a forcing screw nut to threadably engage an end of the forcing screw, a tube, a bearing installer, a washer, a hex nut, a hex head cap screw, an adapter, a wheel hub installer, a bearing remover, a sleeve, a small adapter assembly, a race puller adapter, an outer tie rod remover, and an adapter for a specific model of car.

The adapter 20 may be sold separately to make existing kits more versatile. The adapter 20 is therefore configured to be attached to the cross bar 14 of the puller tool 12. The cross bar 14 may have a central portion 26 with a through hole 24 for the forcing screw 16. The forcing screw 16 is configured to extend through the through hole 24. The through hole 24 defines a first axis 25. The central portion 26 has a first minimal radial dimension 42 that is perpendicular to the first axis 25. However, the cross bar 14 may have a constant thickness over its entire length. The adapter 20 comprises a threaded hole 34 configured to receive the forcing screw 16 and defines a second axis 35. The first axis 25 and second axis 35 can be substantially aligned. The adapter 20 further has a base portion 44 containing the threaded hole 34. The base portion 44 can be arranged adjacent the first axial 38 side of the cross bar 14. At least a first wall portion 46 extends away from the base portion 44 and is arrangeable adjacent to the first lateral side 48 of the central portion 26 of the cross bar 14. The first wall portion 46 has at least a first distance 50 from the second axis 35. The first distance 50 is at least half as big as the first minimal radial dimension 42 of the central portion 26. The adapter 20 is detachably attachable to the cross bar 14.

The adapter 20 is attachable to the cross bar 14 with the ball detents 36. The ball detents 36 are the first wall portion. Even though the adapter 20 may only have the first wall portion 46 it may also have the second wall portion 52 which also extends away from the base portion 44 and is also arrangeable adjacent to the second lateral side 54 of the central portion 26 or the cross bar 14 which is opposite from the first lateral side 48. The second wall portion 52 has at least a second distance 53 from the second axis 35. The second distance 53 is as big as the first distance 50 so that the central portion 26 is receivable within the adapter 20. The adapter 20 is further configured to transmit torque from the threaded hole 34 through the base portion 44 and at least one sidewall portion 46 and/or 52 to at least one lateral side 48 and/or 54 of the cross bar 14.

The adapter 20 is attachable to the cross bar 14 with at least one attachment device selected from a group consisting of ball detents, thumb screws, clamps, straps, springs, and magnets, and wherein the at least one attachment device is arranged at least in the second wall portion.

The first and second wall portions 46 and 52 are curved so they fit around the central portion 26. The first wall portion 46 and the second wall portion 52 extend along the lateral sides 48 and 54 of the cross bar 14 respectively away from the central portion 26 with first and second outer wall segments 46.2, 46.3 and 52.2, 52.3. The outer wall segments 46.2, 46.3 and 52.2, 52.3 are flat and parallel to each other. The wall portions 46 and 52 contain at least two ball detents 36.

Figure 8:
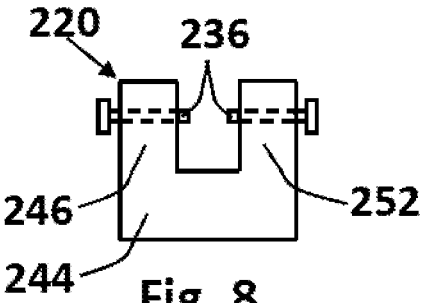
FIG. 8 is a side view of an adapter according to another embodiment.
Figure 9:
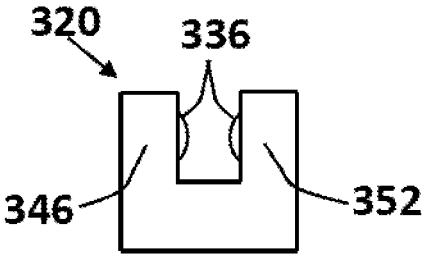
FIG. 9 is a side view of an adapter according to a further embodiment.
Figure 10:
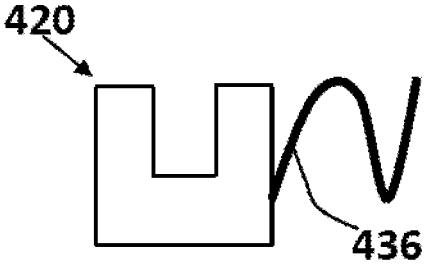
FIG. 10 is a side view of an adapter according to yet another embodiment.
Figure 11:
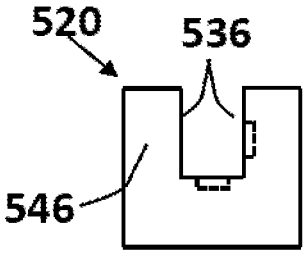
FIG. 11 is a side view of an adapter according to a final embodiment.

Besides ball detents 36 other attachment devices can be used. FIG. 8 illustrates an adapter 220 with thumb screws 236 in wall portions 246 and 252. The thumb screws 236 may also be arranged in a through hole in a base portion 244 and be received in a threaded hole in a first axial side of a cross bar. FIG. 9 illustrates an adapter 320 with springs 336 that are arranged on wall portions 346 and 352 facing each other. One spring 336 may be sufficient. FIG. 10 illustrates an adapter 420 with a strap 436 which can be wrapped around a cross bar and then secured to the adapter 420 or itself. FIG. 11 illustrates an adapter 520 with magnets 536. The magnets 536 may be sitting in recesses in a base portion 544 or one or several wall portions 546, 552. Thus, the ball detents 36, thumb screws 236, springs 336, strap 446 and magnets 536 form a group of attachment devices from which at least one is chosen. All these attachment devices allow adapters to be attached and removed without the use of tools. Of course, attachment devices that require tools may be used as well.

What is claimed is:

1. A puller tool comprising:

a cross bar with a central portion having a through hole defining a first axis;

a forcing screw configured to extend through the through hole; and an adapter detachably attached to the cross bar and having a threaded hole defining a second axis for the forcing screw, wherein the first axis and second axis are substantially aligned, wherein the central portion has a first minimal radial dimension perpendicular to the first axis, wherein the adapter has a base portion containing the threaded hole and at least a first wall portion extending away from the base portion and arranged adjacent to a first lateral side of the central portion of the cross bar, wherein the at least first wall portion has at least a first distance from the second axis, wherein the first distance is at least half as big as the first minimal radial dimension of the central portion, wherein the adapter has a second wall portion extending away from the base portion and parallel to the first wall portion, wherein the second wall portion is arranged adjacent to a second lateral side of the central portion of the cross bar opposite from the first lateral side, wherein the second wall portion has at least a second distance from the second axis, wherein the second distance is as big as the first distance so that the central portion is received within the adapter, wherein the central portion of the cross bar is arranged between the first wall portion and the second wall portion, and wherein the first and second wall portions are curved around the central portion.

2. The puller tool of claim 1, wherein the adapter is attachable to the puller tool and detachable from the puller tool without the use of another tool.

3. The puller tool of claim 1, wherein the adapter is attached to the cross bar with at least one attachment device selected from a group consisting of ball detents, thumb screws, clamps, straps, springs, and magnets.

4. The puller tool of claim 1, wherein the cross bar has a first axial side and a second axial side opposite from the first axial side, wherein the adapter is located on the first axial side, and wherein the forcing screw has a bolt head which is located on the second axial side.

5. The puller tool of claim 1, wherein the first wall portion and the second wall portion extend along the lateral sides of the cross bar away from the central portion with first and second outer wall segments, wherein the outer wall segments are flat and parallel to each other.

6. The puller tool of claim 5, wherein the adapter is attached to the cross bar with at least one attachment device selected from a group consisting of ball detents, thumb screws, clamps, straps, springs, and magnets, and wherein the at least one attachment device is contained in at least one of the outer wall segments.

7. The puller tool of claim 6, wherein the first lateral side and the second lateral side each have a recess, and wherein the at least one attachment device is arranged in one of the recesses.

8. The puller tool of claim 1, wherein the puller tool comprises jaws arranged on the cross bar and the adapter is located between the jaws.

9. The puller tool of claim 1, further including a kit of auxiliary tools configured to cooperate with the puller tool to remove and replace a hub, wherein the auxiliary tools include at least one of the following: a forcing screw nut to threadably engage an end of the forcing screw, a tube, a bearing installer, a washer, a hex nut, a hex head cap screw, an adapter, a wheel hub installer, a bearing remover, a sleeve, a small adapter assembly, a race puller adapter, an outer tie rod remover, and an adapter for a specific model of car.

10. An adapter configured to be attached to a cross bar of a puller tool, the cross bar having a central portion, the central portion having a through hole for a forcing screw, the forcing screw configured to extend through the through hole and the through hole defining a first axis, the central portion having a first minimal radial dimension perpendicular to the first axis, the adapter comprising:

a threaded hole configured to receive the forcing screw and defining a second axis, wherein the first axis and second axis are substantially alignable;

a base portion containing the threaded hole and arrangeable adjacent a first axial side of the cross bar;

at least a first wall portion extending away from the base portion and arrangeable adjacent to a first lateral side of the central portion of the cross bar, wherein the at least first wall portion has at least a first distance from the second axis, and wherein the first distance is at least half as big as the first minimal radial dimension of the central portion, wherein the adapter is detachably attachable to the cross bar, wherein the adapter has a second wall portion extending away from the base portion and arrangeable adjacent to a second lateral side of the central portion of the cross bar opposite from the first lateral side, wherein the second wall portion has at least a second distance from the second axis, wherein the second distance is as big as the first distance so that the central portion is receivable within the adapter, wherein the adapter is configured to transmit torque from the threaded hole through the base portion and at least one side wall to at least one lateral side of the cross bar, wherein the adapter is attachable to the cross bar with at least one attachment device selected from a group consisting of ball detents, thumb screws, clamps, straps, springs, and magnets, wherein the at least one attachment device is arranged at least in the second wall portion, wherein the first and second wall portions are curved around the central portion, wherein the first wall portion and the second wall portion extend along the lateral sides of the cross bar away from the central portion with first and second outer wall segments, and wherein the outer wall segments are flat and parallel to each other.

11. The puller tool of claim 10, wherein the adapter is attachable to the cross bar with at least one attachment device selected from a group consisting of ball detents, thumb screws, clamps, straps, springs, and magnets.

12. The puller tool of claim 11, wherein the at least one attachment device is arranged in the at least first wall portion.

13. The puller tool of claim 10, wherein the wall portions contain at least two attachment devices selected from a group consisting of ball detents, thumb screws, clamps, straps, springs, and magnets.

* * * * *